US005722659A

United States Patent [19]

Gluth

[11] Patent Number: 5,722,659

[45] Date of Patent: Mar. 3, 1998

[54] GOLF BOARD GAME

[76] Inventor: Henry R. Gluth, 9140 Walnut Dr., Munster, Ind. 46321

[21] Appl. No.: 800,705

[22] Filed: Feb. 14, 1997

[51] Int. Cl.[6] ..... A63F 3/00

[52] U.S. Cl. ..... 273/245

[58] Field of Search ..... 273/242, 243, 273/245

[56] References Cited

U.S. PATENT DOCUMENTS

| | | | |
|---|---|---|---|
| 3,857,568 | 12/1974 | Yoder | 273/245 |
| 4,113,260 | 9/1978 | Sain | 273/245 |
| 4,127,273 | 11/1978 | Bonvetti | 273/245 |
| 4,277,065 | 7/1981 | White | 273/245 |
| 4,364,569 | 12/1982 | Duwell et al. | 273/245 |
| 5,000,460 | 3/1991 | Barbiaux et al. | 273/245 |

FOREIGN PATENT DOCUMENTS

| | | | |
|---|---|---|---|
| 1570910 | 7/1980 | United Kingdom | 273/245 |

*Primary Examiner*—William E. Stoll

[57] ABSTRACT

A new golf board game for simulating a round of golf. The inventive device includes a game board having a representation of a golf course thereon including tees, fairways, greens, sand traps, water hazards, trees and rough, markings on each fairway providing an indication of distance along each fairway, a first plurality of dice having only numerical indicia thereon, and a second plurality of dice having a combination of alphanumeric indicia thereon. The dice are rolled to determine the distance of a shot along the fairway until the green is reached. A spinner is then used to determine the number of putting strokes taken while on the green. The second plurality of dice include the letters "H", "S", and "OB" which determine the direction of a particular shot. Penalty cards are provided for use when a shot lands in a sand trap, a water hazard, among trees, or in the rough.

1 Claim, 4 Drawing Sheets

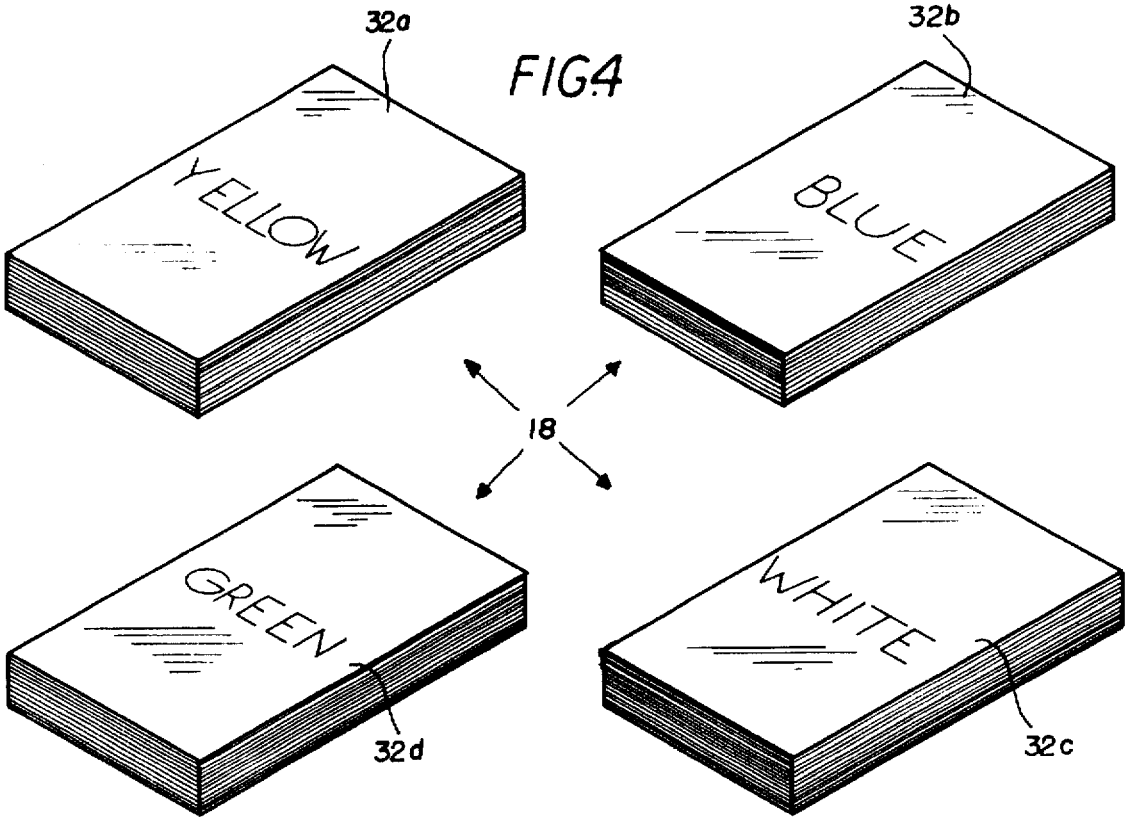
FIG4
FIG. 5A
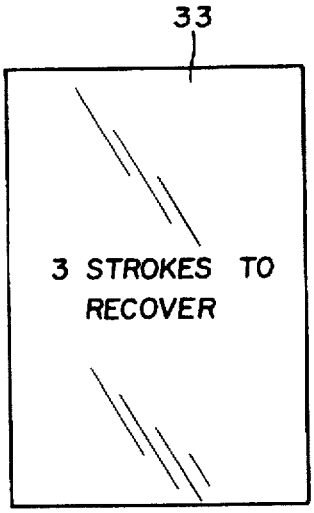
FIG.5B
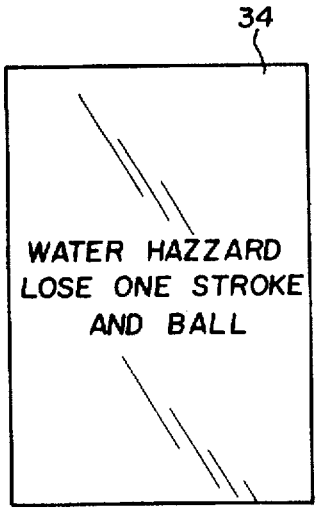

GOLF BOARD GAME

BACKGROUND OF THE INVENTION

1. Field of the Invention

The present invention relates to board games and more particularly pertains to a new golf board game for simulating a round of golf.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf board games include U.S. Pat. No. 5,000,460; U.S. Pat. No. 4,380,338; U.S. Pat. No. 5,316,302; U.S. Pat. No. 5,273,290; U.S. Pat. No. 4,790,534; and U.S. Pat. Des. No. 341,383.

While these devices fulfill their respective, particular objectives and requirements, the aforementioned patents do not disclose a new golf board game. The inventive device includes a game board having a representation of a golf course thereon including tees, fairways, greens, sand traps, water hazards, trees and rough, markings on each fairway providing an indication of distance along each fairway, a first plurality of dice having only numerical indicia thereon, and a second plurality of dice having a combination of alphanumeric indicia thereon. The dice are rolled to determine the distance of a shot along the fairway until the green is reached. A spinner is then used to determine the number of putting strokes taken while on the green. The second plurality of dice include the letters "H", "S", and "OB" which determine the direction of a particular shot. Penalty cards are provided for use when a shot lands in a sand trap, a water hazard, among trees, or in the rough.

In these respects, the golf board game according to the present invention substantially departs from the conventional concepts and designs of the prior art, and in so doing provides an apparatus primarily developed for the purpose of simulating a round of golf.

SUMMARY OF THE INVENTION

In view of the foregoing disadvantages inherent in the known types of board games now present in the prior art, the present invention provides a new golf board game construction wherein the same can be utilized for simulating a round of golf.

The general purpose of the present invention, which will be described subsequently in greater detail, is to provide a new golf board game apparatus and method which has many of the advantages of the board games mentioned heretofore and many novel features that result in a new golf board game which is not anticipated, rendered obvious, suggested, or even implied by any of the prior art board games, either alone or in any combination thereof.

To attain this, the present invention generally comprises a game board having a representation of a golf course thereon including tees, fairways, greens, sand traps, water hazards, trees and rough, markings on each fairway providing an indication of distance along each fairway, a first plurality of dice having only numerical indicia thereon, and a second plurality of dice having a combination of alphanumeric indicia thereon. The dice are rolled to determine the distance of a shot along the fairway until the green is reached. A spinner is then used to determine the number of putting strokes taken while on the green. The second plurality of dice include the letters "H", "S", and "OB" which determine the direction of a particular shot. Penalty cards are provided for use when a shot lands in a sand trap, a water hazard, among trees, or in the rough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new golf board game apparatus and method which has many of the advantages of the board games mentioned heretofore and many novel features that result in a new golf board game which is not anticipated, rendered obvious, suggested, or even implied by any of the prior art board games, either alone or in any combination thereof.

It is another object of the present invention to provide a new golf board game which may be easily and efficiently manufactured and marketed.

It is a further object of the present invention to provide a new golf board game which is of a durable and reliable construction.

An even further object of the present invention is to provide a new golf board game which is susceptible of a low cost of manufacture with regard to both materials and labor, and which accordingly is then susceptible of low prices of sale to the consuming public, thereby making such golf board game economically available to the buying public.

Still yet another object of the present invention is to provide a new golf board game which provides in the apparatuses and methods of the prior art some of the advantages thereof, while simultaneously overcoming some of the disadvantages normally associated therewith.

Still another object of the present invention is to provide a new golf board game for simulating a round of golf.

Yet another object of the present invention is to provide a new golf board game which includes a game board having a representation of a golf course thereon including tees, fairways, greens, sand traps, water hazards, trees and rough, markings on each fairway providing an indication of distance along each fairway, a first plurality of dice having only numerical indicia thereon, and a second plurality of dice having a combination of alphanumeric indicia thereon. The dice are rolled to determine the distance of a shot along the fairway until the green is reached. A spinner is then used to determine the number of putting strokes taken while on the green. The second plurality of dice include the letters "H", "S", and "OB" which determine the direction of a particular shot. Penalty cards are provided for use when a shot lands in a sand trap, a water hazard, among trees, or in the rough.

Still yet another object of the present invention is to provide a new golf board game that teaches the rules of golf while simultaneously providing hours of enjoyment.

Even still another object of the present invention is to provide a new golf board game that simulates the layout of famous golf courses from around the world, thus challenging a golfer who cannot actually play a round of golf on such courses.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a perspective view of the different groups of penalty cards used with the present invention.

FIGS. 5A and 5B show examples of one side of the penalty cards indicating different penalties.

DESCRIPTION OF THE PREFERRED EMBODIMENT

Figure 1:
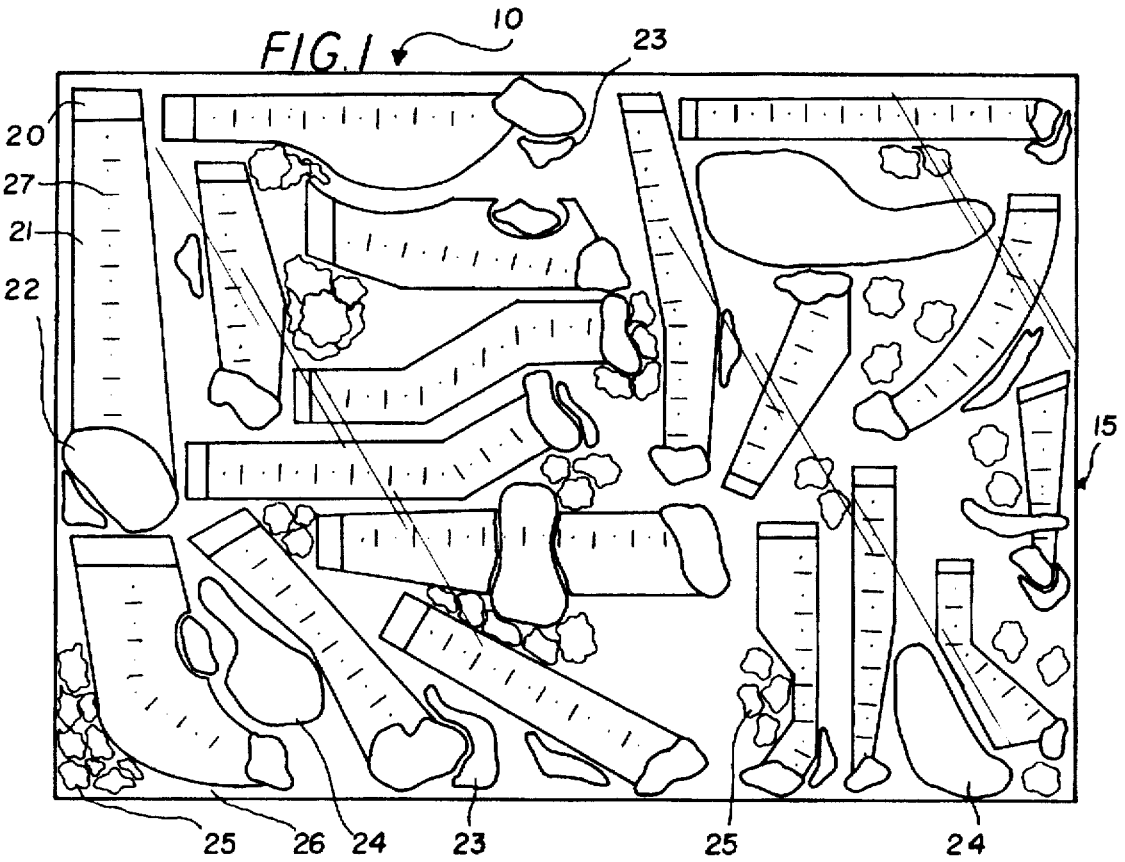
FIG. 1 is a top view of the game board use in the new golf board game according to the present invention.

With reference now to the drawings, and in particular to FIGS. 1 through 6 thereof, a new golf board game embodying the principles and concepts of the present invention and generally designated by the reference numeral 10 will be described.

As best illustrated in FIGS. 1 through 6, the golf board game 10 comprises a game board 15, dice 16, game pieces 17, penalty cards 18, and a spinner 19.

Referring first to FIG. 1, it is seen that the game board 15 is generally flat and rectangular, and includes printed indicia thereon a representation of a golf course. The board 15 is preferably sectioned such that it may be folded up, similar to conventional board games. In the representation illustrated in FIG. 1, an 18-hole course is provided. However, one could use a 9-hole course, or any number of hole course, without changing the scope of the invention. Each hole includes a tee 20, fairway 21, and a green 22. The course also includes representative sand traps 23, water hazards 24, stands of trees 25, and rough 26 which is generally considered to be located along the sides of the fairways 21 and around the greens 22. Thus it can be seen that the representative golf course is meant to simulate a real golf course and include many of the hazards normally associated therewith.

A wide variety of both real courses and made up courses could be provided on the board. For instance, the Augusta National or Pebble Beach courses could be simulated. Since most golfers will never have a chance to play these two courses, this game 10 would teach the actual hole configuration of such courses and the thought process required to play such famous and challenging courses.

Each fairway 21 includes markings 27 along the entire length thereof from the tee to the green, thus dividing the fairway into equal increments. For instance, each fairway could be marked so to divide the fairway into ten yard increments. Numerical indicia representing the yardage could be included with each individual marking 27, so as to indicate the distance along the fairway.

Figure 2:
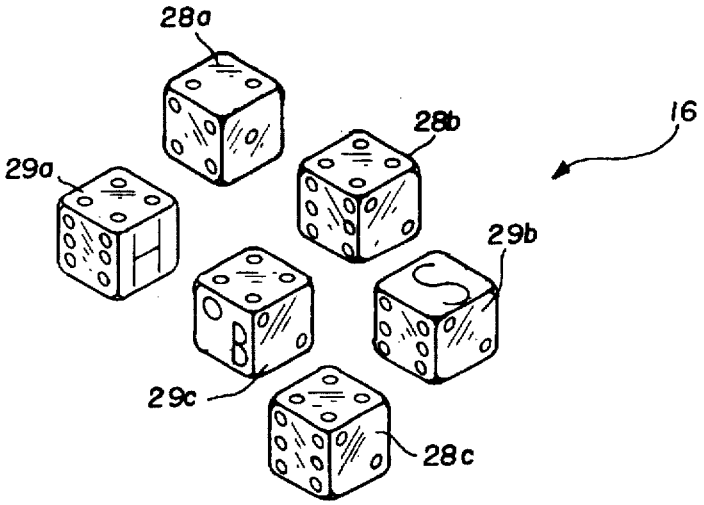
FIG. 2 is a perspective view of all the dice used in the present invention.

The plurality of dice 16 are used to control a player's movement along each fairway 21. The dice 16 include a first plurality of standard six-sided dice 28*a,b,c* having indicia thereon representing the numbers 1 to 6. The dice 16 further include a second plurality of six-sided dice 29*a,b,c*, which also have the standard indicia thereon representing the numbers 1 to 6. However, as is shown in FIG. 2, the dice 29*a,b,c* each include a letter on one side in addition to the numerical indicia. As illustrated, the die 29*a* includes the letter "H" imprinted on the side containing the number 1, the die 29*b* includes the letter "S" imprinted on the side containing the number 2, and the die 29*c* includes the letters "OB" imprinted on the side containing the number 6. The letter "H" stands for "hook", meaning the particular shot hooked. The letter "S" stands for "slice", meaning a shot sliced. The letters "OB" stand for "out of bounds", meaning a shot went out of bounds.

Figure 3:
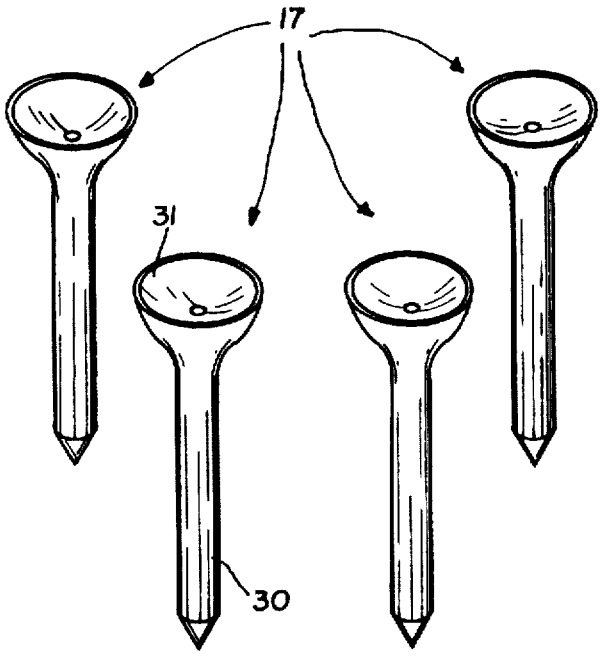
FIG. 3 is a perspective view of game pieces used with the present invention.

FIG. 3 shows the game pieces 17 used by each player. The pieces have the shape of a standard golf tee, including a stem portion 30 and a cup-shaped, enlarged head portion 31. The pieces 17 are inverted so that they are supported by their head portions 31 as the pieces 17 are moved around the board 15.

The game 10 further includes a plurality of groups 32*a,b,c,d* of penalty cards 18. The group 32*a* includes twelve cards therein, with each card marked on one face thereof with the words "sand" and "yellow". These cards are to be used when a player ends up in a sand trap 23. The cards within the group 32*a* are provided on their opposite side with a particular penalty which is appropriate when a sand trap is encountered. FIG. 5A illustrates one card 33 having one example of such a penalty.

The group 32*b* includes eleven cards therein having the words "water" and "blue" on one face, for use when a player encounters a water hazard 24. The opposite face of these cards would include a penalty thereon to indicate a penalty for ending up in the water hazard, such as is illustrated by one card 34 in FIG. 5B. The group 32*c* comprises fourteen cards with the words "rough" and "white" on one face, for use when a player ends up in the rough 26. These cards would also include an appropriate penalty on the opposite face thereof. The group 32*d* comprises fifteen cards with the words "trees" and "green" on one face, for use when a player ends up in the trees 25, and would also include a penalty on the opposite face.

Figure 6:
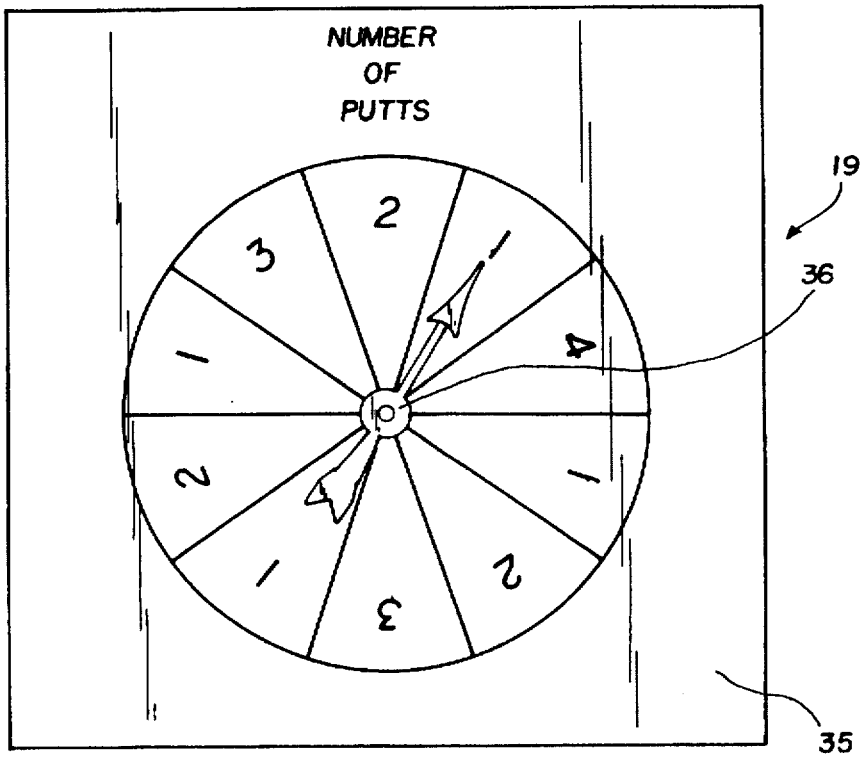
FIG. 6 is a top view of the spinner used with the present invention.

FIG. 6 shows the spinner 19 which is to be used when a player reaches the green 22, to indicate the number of putting strokes taken for each player. The spinner 19 comprises a flat board 35 having a circle provided thereon which is divided into ten equal segments. Each segment includes a number associated therewith which indicates the number of putting strokes. A pointer 36 is rotationally attached to the center of the circle, as is usual in these type of game spinners, such that it can be spun relative to the board to fall within a particular segment, thus indicating the number of putts.

A score pad having a plurality of score sheets can also be included in order to allow the players to keep score, or else a sheet of excess paper can be used. Additionally, a book containing the rules of the game can be included.

Exemplary Rules of the Game

The game may be played by the following set of rules. Each player selects a game piece 17 and starts at the tee 20 of a hole, preferably the first hole. The players roll the dice 16 to simulate a shot, with each throw counting as a stroke. For each player's initial throw, the player gets to choose how many dice he throws, but one of the dies 29*a,b,c* containing either the hook, slice, or out of bounds must be one of the dice thrown. If more than one of the dies 29*a,b,c* is thrown at the same time and at least two of the letters turn up, they cancel each other out. For instance, if both "H" and "S" turn up at the same time, they cancel each other and the shot is considered to be straight. For each roll of the dice, the numbers which turn up on the dice are added, indicating the total yardage of that shot. The player counts the markings 27 equal to the yardage of the roll, and moves the game piece accordingly. Although the number of dice thrown is the player's choice, as you get closer to the green the total number of dice thrown would normally be less, since less yardage remains to the green. The die 29*c* containing the out of bounds is not to be used from 150 yards to the green. Once you get within ten yards of the green, you are considered to be on the green, and the spinner is then used to determine your number of putts on that hole. The cards 18 are utilized when a player's shot lands in one of the sand traps, water hazard, rough, or amongst the trees, and the penalty on the card is applied. Normal rules of golf are applied for out of bounds situations. After each players initial throw, the usual rules of golf are followed concerning who shoots next. As in a real game of golf, all players must be on the green before the players spin to determine putting strokes. Other rules could of course be followed when playing this game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf board game, comprising:

a game board having a representation of a golf course showing a plurality of individual holes thereon with tees, fairways, greens, sand traps, water hazards, trees, and rough;

each said fairway including equally spaced markings along the length thereof indicative of distance along the fairway;

a plurality of player game pieces each resembling a golf tee for moving about said game board as a representative of the player's golf ball;

a first plurality of dice having only numerical indicia thereon for indicating the distance a player may advance a token along a fairway; and a second plurality of dice having a combination of alphanumeric indicia thereon, wherein the second plurality of dice include the letters "H", "S", and "OB" thereon, said letters determining the direction of a shot, wherein a dice roll of "H" indicates a "hook" shot, wherein a dice roll of "S" indicates a "slice" shot, and wherein a dice roll of "OB" indicates an "out-of-bounds" shot;

a spinner device having indicia thereon indicating the number of putting strokes required to move to the hole, wherein a player spins said spinner device upon reaching a putting green space to determine the number of strokes to be assessed said player; and a plurality of groups of penalty cards, each card having first indicia on a first side thereof and second indicia on a second side thereof, wherein said first indicia associated with a first said group of penalty cards identifies said first group of cards for use when a player's game piece is in a sand trap, said first indicia associated with a second said group of penalty cards identifies said second group of cards for use when a player's game piece is in a water hazard, said first indicia associated with a third said group of penalty cards identifies said third group of cards for use when a player's game piece is in the rough, and said first indicia associated with a fourth said group of penalty cards identifies said fourth group of cards for use when a player's game piece is among the trees, wherein a player chooses from a said group of cards when said player moves a game piece onto a portion of a hole representing a sand trap, a water hazard, trees or a rough; and wherein said second indicia on each card of each group of cards indicates a stroke penalty to be assessed a player drawing the card.

* * * * *